US005499448A

United States Patent [19]

Tournier et al.

[11] Patent Number: 5,499,448

[45] Date of Patent: Mar. 19, 1996

[54] PROCESS FOR CONNECTING AN ELECTRIC CABLE TO AN END MEMBER

[75] Inventors: Gilles Tournier, Lequevin; Serge Roques, Blagnac; Jean-Luc Ballenghien, Blagnac, all of France

[73] Assignee: Aerospace Societe Nationale Industrielle, Paris, France

[21] Appl. No.: 275,953

[22] Filed: Jul. 15, 1994

[30] Foreign Application Priority Data

Jul. 19, 1993 [FR] France ..... 93 08818

[51] Int. Cl.[6] ..... H01B 43/00

[52] U.S. Cl. ..... 29/863; 29/862; 29/871; 439/877

[58] Field of Search ..... 29/857, 862, 863, 29/861, 871; 439/877

[56] References Cited

U.S. PATENT DOCUMENTS

| | | | |
|---|---|---|---|
| 2,297,785 | 9/1941 | Lake . | |
| 2,803,695 | 8/1957 | Wooley, Jr. | 29/871 X |
| 3,010,184 | 11/1961 | Forney, Jr. | 29/863 X |

FOREIGN PATENT DOCUMENTS

| | | |
|---|---|---|
| 286530 | 10/1988 | European Pat. Off. . |
| 2544927 | 4/1977 | Germany . |
| 954409 | 4/1964 | United Kingdom . |
| 977466 | 12/1964 | United Kingdom . |

*Primary Examiner*—Timothy V. Eley
*Assistant Examiner*—Khan V. Nguyen
*Attorney, Agent, or Firm*—Michael N. Meller

[57] ABSTRACT

The invention relates to a method of tightly electrically connecting an electric cable (12) to an end member (10) such as an electric contact, it is proposed that the partly bared or stripped end of the cable be introduced into a stepped blind hole (26) formed in a rear connection part (10*b*) of the member (10). More specifically, the bared cable end is received in two cylindrical sections (26*a*, 26*b*) of the hole (26), in which have been inserted beforehand a transparent sleeve (30), capping an inspection hole (32), and a metal interface ring (34). The unbared part of the cable is received in a cylindrical entrance section (26*c*) of the hole (26). Then, by wiredrawing, the partly truncated cone-shaped, outer surface of the part (10*b*) is deformed in order to give it a cylindrical shape.

5 Claims, 3 Drawing Sheets

PROCESS FOR CONNECTING AN ELECTRIC CABLE TO AN END MEMBER

FIELD OF THE INVENTION

The invention relates to a process making it possible to connect an electric cable to an end member such as a connector contact. The invention also relates to an end member usable for performing this process.

BACKGROUND OF THE INVENTION

The invention mainly applies to the connection of electric cables having a light metal, such as aluminium, core, covered by an insulating sheath. However, it can also be used for the connection of cables, whose core is made from any other material such as copper, particularly when it is desirable to have a sealing of the connection and/or when it is wished for the connection to take place in a non-aggressive manner for the cable.

In industries such as the aeronautical industry requiring considerable electric cable lengths and for which financial and/or weight gains are desired, certain large cross-section, copper core cables have for some time been replaced by aluminium core cables. Thus, despite the need to use aluminium core cables with a larger cross-section for compensating a reduced conductivity compared with that of copper, the mass balance gives a gain of approximately 50%.

In order to take greater advantage of the weight gain resulting from the use of aluminium core cables, it would be logical to also replace smaller cross-section copper core cables by aluminium core cables. This more particularly relates to the copper core cables between gauge 10 (4.9 $mm^2$ cross-section) and gauge 24 (0.2 $mm^2$ cross-section).

However, although the tensile strength difference between the two materials causes no particular problems with cables with a cross-section greater than 5 $mm^2$, it becomes critical for cables having a smaller cross-section. Thus, the forces exerted on the cables, particularly when producing cable bundles, may then be prejudicial to the electrical continuity of the circuits and therefore to the safety of aircraft.

Another problem relates to the sensitivity of aluminium to chemical attacks. This sensitivity makes it necessary for the connection between the aluminium cable and the copper contact to be tight, so as to insulate the aluminium from the ambient medium, which is not necessary when a copper cable is used.

However, bearing in mind the larger diameter of aluminium core cables compared with copper core cables for an equivalent resistivity, any diameter increase of the contacts for ensuring the sealing and tensile strength of the connection makes it difficult or even impossible to use the standardized tools necessary for the fitting and unlocking of contacts, when use is made of the most widely used connectors where the contacts are unlocked from the rear.

Moreover, an increase in the diameter of the cavities formed on standardized connectors for receiving the standardized contacts is difficult to envisage without a modification to the location of the cavities, as a result of the proximity thereof to the existing connectors. However, a modification to the positions of the cavities would be the equivalent of rendering obsolete all the presently used, standardized connectors.

Finally, a change in the connection technology for the use of contacts with unlocking from the front would require important modifications and the creation of novel connectors, which is clearly not desirable.

GB-A-977,466 proposes the connection of an electric cable to an end member such as an electric contact by introducing the end of the cable into a blind hole or bore having a uniform diameter and machined in a connection zone of the end member. The outer surface of said connection zone is initially a truncated cone-shaped surface, whose diameter increases towards the open end of the hole. The end member is made from a ductile metal, so that a radial compacting force exerted on the connection zone has the effect of giving the outer surface of said zone a uniform diameter, cylindrical shape. Thus, a mechanical connection is formed, which opposes the separation of the end member and the cable.

However, the solution described in GB-A-977,466 is not applicable to an aluminium core cable with a cross-section below 5 $mm^2$ in view of the limited tensile strength of such a cable. In addition, no matter what the nature of the metal from which the cable is made, the solution described in GB-A-977,466 does not make it possible to obtain a tight connection.

The main object of the invention is a process making it possible to connect an electric cable, such as a small cross-section aluminium core cable, to an end member such as an electric contact so as to ensure a stable and reliable electrical connection, a satisfactory mechanical strength and the necessary sealing with respect to the external ambient, without complicating implementation, without rendering obsolete the presently used, standardized connection systems and whilst retaining to the greatest possible extent the use of existing tools.

SUMMARY OF THE INVENTION

According to the invention, this result is obtained by means of a process for the connection of an electric cable to an end member, whose rear connection part has a blind hole and an outer surface having at least one truncated cone-shaped portion, whose diameter increases towards an open end of the hole, in which:

the cable is introduced into the blind hole and the rear connection portion is radially compacted in order to give the outer surface a cylindrical shape, characterized in that use is made of a cable having a core covered with an insulating sheath, the cable is bared over a length smaller than that of the blind hole, the cable is introduced into a stepped blind hole formed from at least two cylindrical sections each having a chamfered entrance end, so that an unbared portion of the cable is received in an entrance section of the hole, the truncated cone-shaped portion of the outer surface being positioned around the entrance section and at least one other section of the hole and the connection zone of the end member is radially compacted by wiredrawing, exerting a tension on said member, so as to pass the connection zone into a calibrated die.

As a result of these characteristics, the mechanical connection between the end member and the core of the cable is completed by a mechanical connection between the end member and the insulating sheath. In view of the fact that the latter is generally made from a plastics material having high mechanical and electrical performance characteristics, the mechanical strength is improved and makes it possible to envisage the connection of a light metal core, small cross-section cable. Moreover, the thus formed connection is tight and not aggressive for the cable.

In a preferred embodiment of the invention, use is made of an end member having at least one inspection hole issuing into a bottom section of the blind hole and a transparent sealing sleeve is placed in said bottom section prior to the introduction of the cable into the blind hole.

The inspection hole makes it possible to treat the interior of the blind hole before positioning therein the transparent sealing sleeve. As a result of the transparency of the sleeve, it also makes it possible to check the good fitting of the core of the cable when the connection has been made. The transparent sleeve then maintains the seal of the connection.

Advantageously and more particularly when using a cable with a light metal core, an interface ring made from an electrically conductive material such as silver is placed in an intermediate section of the hole before installing the transparent sealing sleeve in the bottom section and before introducing the cable into the blind hole. This interface ring serves to improve the electrical contact between the cable core and the end member whilst compensating the expansion difference between the materials forming these two parts. To facilitate the introduction of the cable into the blind hole, whilst avoiding any need for foolproofing, the interface ring is chamfered towards the inside at its two ends.

The invention also relates to an end member usable during the implementation of the connection process defined hereinbefore.

More specifically, it proposes an end member to be fitted by radial compacting onto the end of an electric cable, said member having a front portion and a rear connection portion, the latter having a blind hole able to receive one end of the cable, and an outer surface having at least one truncated cone-shaped portion, whose diameter increases towards an open end of the blind hole, characterized in that the end member is intended to be fitted on the end of a cable having a core covered with an insulating sheath, bared over a length smaller than that of the blind hole, the latter being stepped and formed from at least two cylindrical sections, each having a chamfered entrance end, an entrance section of the hole being able to receive an unbared portion of the cable, the truncated cone-shaped portion of the outer surface being located around the entrance section and at least one other section of the hole, and the front portion has a shoulder directed towards the rear connection portion able to serve as an anchoring means for the tension device, for the radial compacting of the rear connection portion by wiredrawing.

When the blind hole formed in the connection zone of the end member comprises an entrance section, an intermediate section and a bottom section, the outer surface of said hole has a cylindrical section surrounding the bottom section of the hole and a truncated cone-shaped section surrounding the intermediate section and the entrance section of the hole.

The invention is described in greater detail hereinafter relative to a non-limitative embodiment and with reference to the attached drawings, wherein show:

DESCRIPTION OF THE PREFERRED EMBODIMENT

Figure 1:
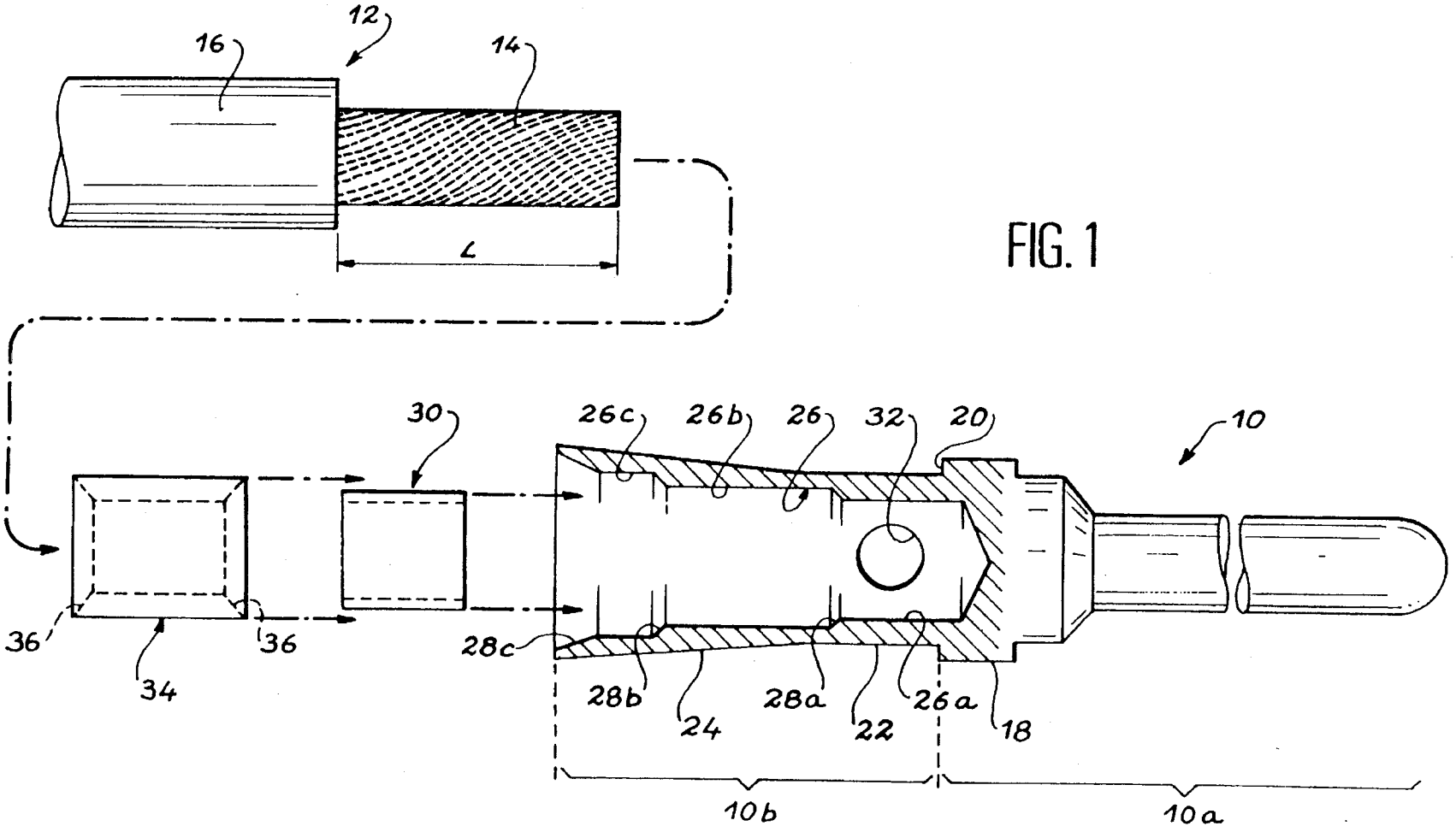
FIG. 1 a partial longitudinal sectional view of an end member such as an electric contact for connection to the end of an electric cable.

FIG. 1 shows an end member 10 such as an electric contact, prior to its connection to the end of an electric cable 12 formed from a core 14 and an insulating sheath 16. The core 14 of the cable 12 can be made from a random metal, although the invention is advantageously applicable to the case where said core is made from a light metal such as aluminium. The insulating sheath 16 is made from a plastics material having high mechanical and electrical performance characteristics. It covers the core 14 of the cable 12, with the exception of its end, which is bared or stripped over a predetermined length L. The end member 10 is made from an electrically conductive material having good cold deformation characteristics, such as a copper alloy.

The end member 10 has a symmetry of revolution about a longitudinal axis and has a standardized front portion 10*a* strictly identical to the front portion of existing contacts, as well as a rear connection portion 10*b*, whose shape has been modified in accordance with the invention.

In the case where the end member is constituted by an electric contact in the manner illustrated in FIG. 1, the front portion 10*a* is identical to that of standardized male contacts. However, said front portion 10*a* can assume other shapes and dimensions in accordance with the envisaged application. These shapes can in particular be those of a female contact or an end fitting. For a reason which will become apparent hereinafter, it is important to observe that the front portion 10*a* of the end member 10 has a flange 18 defining a shoulder 20 turned towards the rear connection portion 10*b*.

The rear connection portion 10*b* of the end member 10, which commences immediately to the rear of the shoulder 20, has an outer surface which successively defines, starting from the said shoulder, a uniform diameter, cylindrical portion 22 and a truncated cone-shaped portion 24, whose diameter increases from the cylindrical portion 22 up to the rear end of the member 10. As illustrated by FIG. 1, the length of the truncated cone-shaped portion 24 is substantially double the length of the cylindrical portion 22.

Moreover, a stepped blind hole or bore 26 is formed coaxially in the rear connection portion 10*b* of the end member 10 and extends up to the interior of the flange 18. Starting from the bottom, said bore or hole 26 has a cylindrical bottom section 26*a* with a relatively small diameter, an intermediate, cylindrical section 26*b*, whose diameter slightly exceeds that of the bottom section 26*a* and a cylindrical, entrance section 26*c*, whose diameter slightly exceeds that of the intermediate section 26*b*. At their entrance end, each of the cylindrical sections 26*a*,26*b* and 26*c* has a chamfer 28*a*, 28*b* and 28*c* respectively.

Outside its end located within the flange 18, the bottom section 26*a* of the hole 26 is completely located within the cylindrical portion 22 of the outer surface of the rear connection portion 10*b*. The intermediate section 26*b* of the hole 26, whose length slightly exceeds that of the bottom section 26*a* is mainly located within the truncated cone-shaped portion 24 of the outer surface of the rear connection portion 10*b* and extends slightly into the cylindrical portion 22. Finally, the entrance section 26*c* of the hole 26 is totally located within the truncated cone-shaped portion 24 and has a length less than that of the cylindrical sections 26*a* and 26*b*.

It should also be noted that the length L of the bared portion of the cable 12 is predetermined so as to slightly exceed the combined length of the sections 26*a* and 26*b* of the hole 26, but is significantly less than the total length of said hole 26.

The bottom section 26*a* of the hole 26 has a calibrated diameter equal to the diameter of the core 14 of the cable 12, increased by a slight clearance and two thicknesses of a transparent sealing sleeve 30 provided for slight force fitting in said bottom section 26*a*. The transparent sealing sleeve 30 can be manufactured from a tubular, extruded plastics material sheath cut at regular intervals. It has a totally symmetrical shape, so that it can be fitted in the bottom section 26*a* of the hole 26 without having to carry out a long and costly foolproofing.

An inspection hole 32 is made radially in the rear connection portion 10*b* of the end member 10, so as to issue onto the cylindrical portion 22 of the outer surface of said rear portion 10*b* and in the bottom section 26*a* of the blind hole 26. This inspection hole 32 facilitates the treatment of the surface of the blind hole 26, i.e. the optional deposition of protective coatings on said surface, as well as its rinsing. It also makes it possible to visually check the presence of the core 14 of the cable 12 when the connection has been made.

The intermediate, cylindrical section 26*b* of the blind hole 26 has a calibrated diameter equal to the diameter of the core 14 of the cable 12, increased by a very slight clearance and two thicknesses of an interface ring 34. The interface ring 34 is slightly force fitted into the intermediate section 26*b* of the hole 26. It is machined in a highly conductive material making it possible to improve the contact between the core 14 of the cable 12 (e.g. of aluminium) and the end member 10 (e.g. of a copper alloy). The interface ring 34 also makes it possible to compensate the expansion difference between the materials forming these two parts (expansion coefficient approximately 17 for a copper alloy and approximately 23 for an aluminium alloy). In order to best fulfil these two functions, the interface ring 34 is advantageously made from silver. Thus, the conductivity of silver is satisfactory and its expansion coefficient is approximately 19. It is also an easily machinable and relatively malleable metal.

It should be noted that it is sometimes possible to avoid the presence of the interface ring 34. This is in particular the case when the core 14 of the cable 12 is also made from a copper alloy. It is also the case when the interface ring can be replaced by a metal deposit fulfilling the same function within the hole 26.

In order to facilitate the introduction of the cable 14, the interface ring 34 has at each of its ends an internal chamfer 36. This symmetrical configuration of the interface ring 34 avoids having to use a long and costly foolproofing during installation.

The different stages of the connection of the electric cable 12 to the end member 10 will now be described with successive reference to FIGS. 2A to 2H.

Firstly, a certain number of surface treatments are carried out on the end member 10 using conventional procedures. These surface treatments usually consist of a copper coating of all the internal and external surfaces of the member 12, facilitating the adhesion of the other deposits. A nickel coating can also take place on the front portion 10*a* of the member 10. There can also be either a thin gilding of all the internal and external surfaces of the member 10, or a thick, selective gilding on the front portion 10*a* of said member. Finally, as stated, a silver deposit can be made within the hole 26, particularly when it is wished to obviate the need for the interface ring 34.

The inspection hole 32 permits the escape of the air contained within the hole 26 during electrolytic deposition and facilitates the various rinsing operations.

Figure 2A:
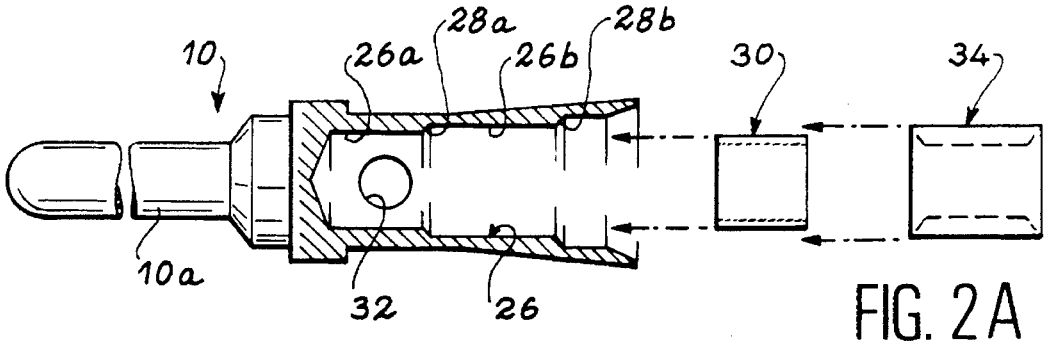
FIGS. 2A to 2H longitudinal sectional views diagrammatically illustrating the main stages of the realization of the connection process according to the invention.

Finally and as illustrated in FIG. 2A, the transparent sealing sleeve 30 is slightly force fitted in the bottom section 26*a* of the hole 26. This operation is facilitated by the presence of the chamfer 28*a* at the entrance of the section 26*a*. When completed, the transparent sealing sleeve 30 extends over the entire length of the bottom section 26*a* and thus tightly caps the inspection hole 32 (FIG. 2B).

The interface ring 34 is slightly force fitted in the intermediate section 26*b* of the hole 26. This operation is facilitated by the chamfer 28*b* located at the entrance of the section 26*b*. When completed, the interface ring 34 occupies the entire length of the intermediate section 26*b*.

Figure 2B:
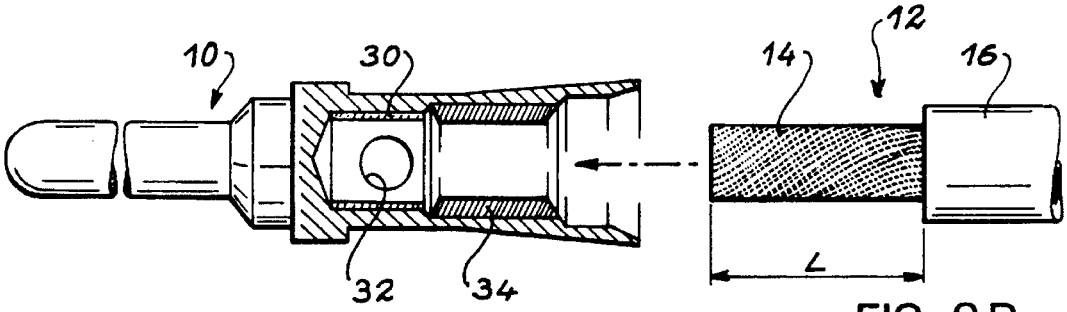

Into the hole 26, equipped with the sleeve 30 and the ring 34, is then introduced the partly bared end of the cable 12, as illustrated in FIG. 2B. As the length L of the bared portion of the cable 12 is less than the total length of the hole 26 and scarcely exceeds the combined length of the sections 26*a* and 26*b* of said hole, the end of the unbared portion of the cable 12 is located in the interior of the entrance section 26*c* of the hole 26 in the vicinity of the chamfer 28*b*, when the end of the cable 10 abuts against the bottom of the hole. It should be noted that the introduction of the cable 10 is facilitated, for its core 14, by the chamfer 36 formed at the entrance of the interface ring 34 and, for its sheath 16, by the chamfer 28*c* formed at the entrance of the entrance section 26*c* of the hole 26. The penetration of the end of the core 14 into the transparent sealing sleeve 30 causes no particular problem, as a result of the internal diameter of said sleeve being slightly larger than the internal diameter of the interface ring 34. It is visually checked through the inspection hole 32 through the transparent sleeve 30.

Figure 2C:
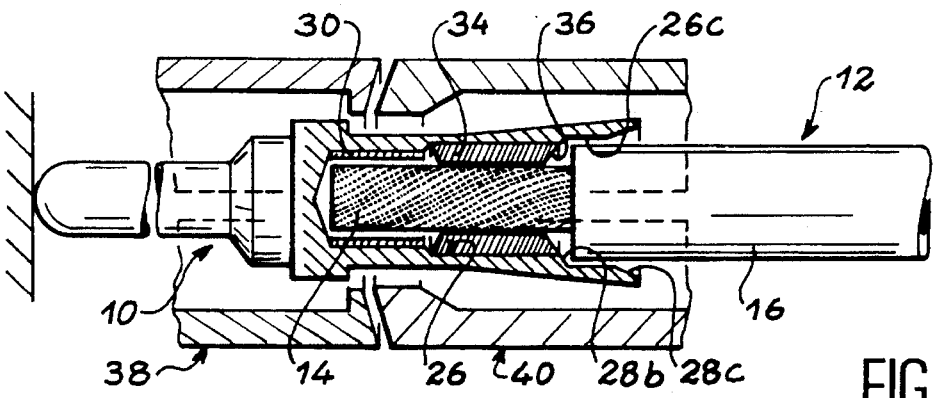

As is also illustrated by FIG. 2*c*, the introduction of the end of the cable 12 into the end member 10 is preceded or followed by the putting into place of the end member 10 in the crimping or swaging tool illustrated in a very diagrammatic manner. This crimping tool comprises pliers 38 and a calibrated die 40.

Figure 2D:
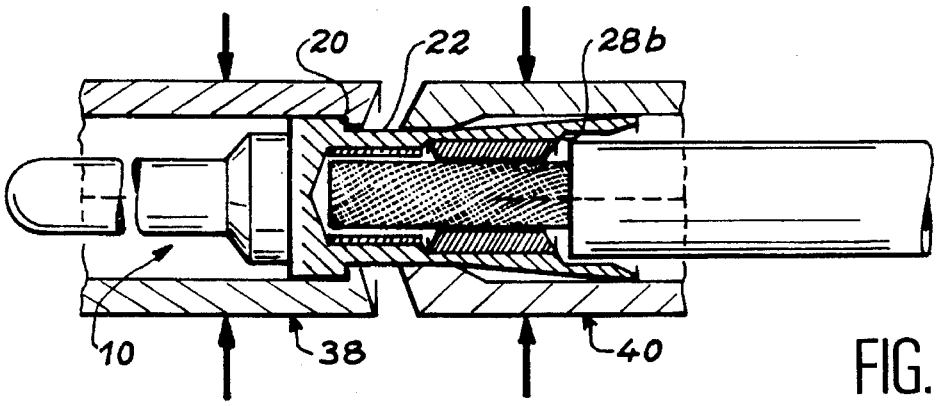

The pliers 38 are formed by at least two jaws locking the end member 10 around the cylindrical portion 22 of its outer surface, so that it can bear on the shoulder 20, as illustrated in FIG. 2D.

The die 40 is also formed from two half-shell portions, which are closed on the cylindrical portion 22 of the outer surface of the end member 10, when the pliers 38 are closed in the manner illustrated by FIG. 2D.

Figure 2E:
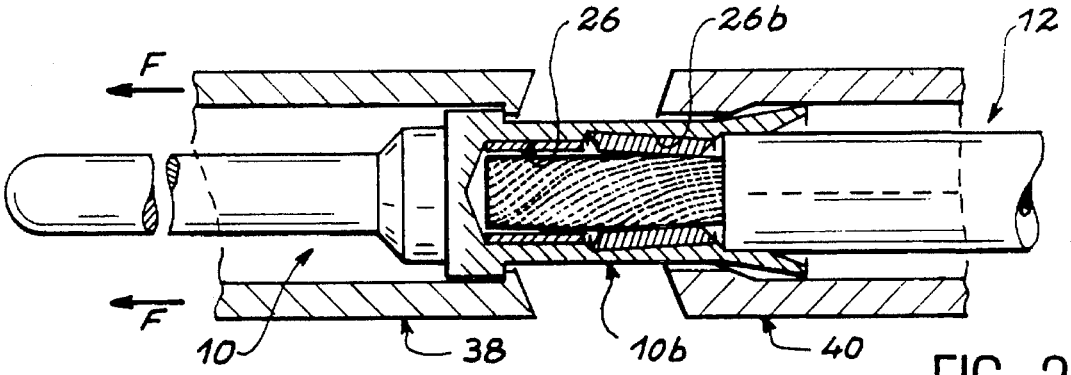
Figure 2F:
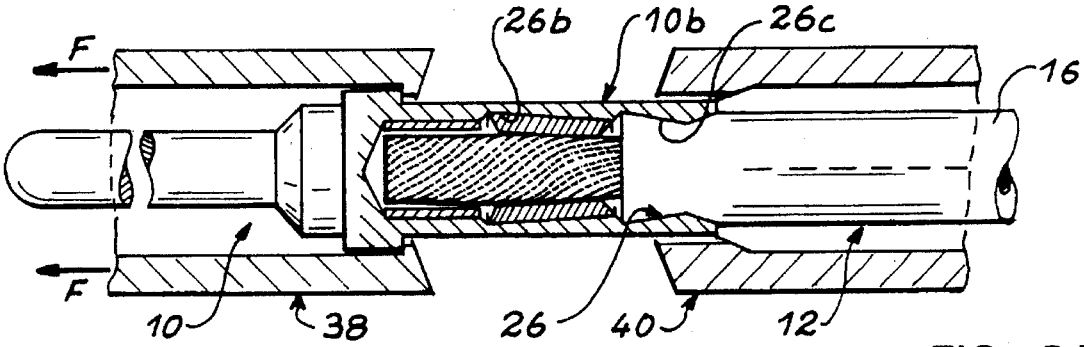

This is followed by the radial compacting of the rear connection portion 10*b* of the end member 10 by wiredrawing, as illustrated by FIGS. 2E and 2F. As indicated by the arrows F therein, this wiredrawing or crimping operation is carried out by exerting a tensile stress on the end member 10, along the axis thereof, by means of the pliers 38, so as to pass over its entire length the rear connection portion 10*b* through the calibrated die 40. This operation transforms the outer surface of the rear connection portion 10*b* into a cylindrical surface, whose uniform diameter is substantially equal to the initial diameter of the cylindrical portion 22.

Thus, the intermediate section 26*b* and the entrance section 26*c* of the hole 26 are given truncated cone shapes, whose diameter decreases towards the open end of the hole 26. The deformation of the intermediate section 26*b* of the hole leads to an identical deformation of the interface ring 34.

Figure 2G:
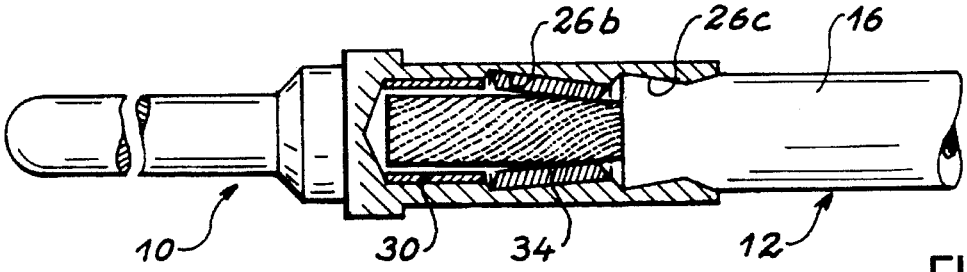
Figure 2H:
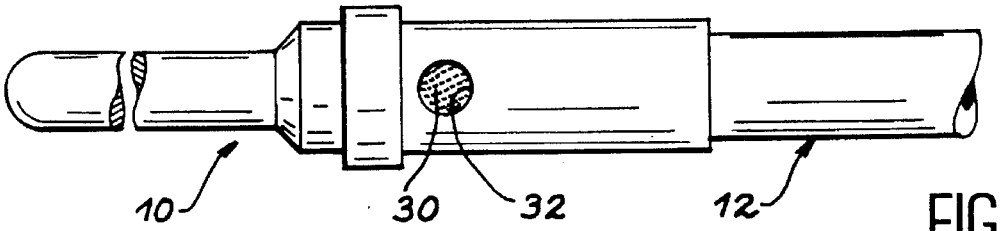

Consequently and as illustrated in FIG. 2G, when this wiredrawing operation is at an end, there is a mechanical connection both between the end member 10 and the core 14 of the cable 12 and between the end member 10 and the cable sheath 16. This mechanical connection prevents any accidental tearing away of the end member and ensures an adequate mechanical strength when the core 14 of the cable 12 has a small diameter and is formed from a light metal such as aluminium. Moreover, the mechanical strength obtained between the end member 10 and the sheath 16 of the cable 12 ensures the sealing of the connection, together with the transparent sealing sleeve 30 to the right of the inspection hole 32 (FIG. 2H).

Thus, a connection is obtained which is particularly appropriate for the use of an aluminium core cable, but whose sealing and non-aggressive character make it possible to envisage its application in the case of a cable having a core made from any other material and in particular copper.

We claim:

1. Process for the connection of an electric cable having a core covered with an insulating sheath to an end member, whose rear connection portion has a blind hole and an outer surface having at least one truncated cone-shaped portion, whose diameter increases towards an open end of the hole along an axial direction, comprising the steps of:

baring the cable over a length smaller than that of the blind hole, introducing the cable into a stepped blind hole formed from at least two cylindrical sections of said rear connection portion of said end member, each of the sections having a chamfered entrance end, so that an unbared portion of the cable is received in an entrance section of the hole, the truncated cone-shaped portion of the outer surface being located around the entrance section and at least one other section of the hole and wiredrawing said end member in said axial direction to cause radial compaction of the rear connection portion of the end member whilst exerting a tension on said member, so as to pass the rear connection portion into a calibrated die to deform the rear portion radially inward for making the connection of the cable to said end member.

2. Process according to claim 1, wherein said end member has at least one inspection hole issuing into a bottom section of the blind hole and further comprising placing, a transparent sealing sleeve in the bottom section before introducing the cable into said blind hole.

3. Process according to claim 2, wherein said inspection hole is used for facilitating the treatment of the interior of the blind hole, prior to the positioning there of the transparent sealing sleeve.

4. Process according to claim 2, wherein, after placing the transparent sealing sleeve in the bottom section and before introducing the cable into the blind hole, further comprising placing an interface ring made from an electrically conductive material in an intermediate section of the blind hole.

5. Process according to claim 4, wherein said interface ring is chamfered at its ends.

* * * * *